US005301761A

United States Patent [19]

Fu et al.

[11] Patent Number: 5,301,761

[45] Date of Patent: Apr. 12, 1994

[54] PRESSURE REVERSING VALVE FOR A FLUID-ACTUATED, PERCUSSIVE DRILLING APPARATUS

[75] Inventors: Chuen-Cheng Fu; Warren T. Lay, both of Roanoke, Va.

[73] Assignee: Ingersoll-Rand Company, Woodcliff Lake, N.J.

[21] Appl. No.: 28,749

[22] Filed: Mar. 9, 1993

[51] Int. Cl.[5] ..... E21B 4/00

[52] U.S. Cl. ..... 175/296; 166/319

[58] Field of Search ..... 175/296; 91/317, 325; 166/319-321

[56] References Cited

U.S. PATENT DOCUMENTS 2,937,619 5/1960 Kurt ..... 175/296
4,022,108 5/1977 Juvonen .
4,070,949 1/1978 Salmi .
4,179,983 12/1979 Wallace .
4,248,133 2/1981 Petukhov et al. .
4,465,497 8/1984 Howeth .
4,467,699 8/1984 LeBlanc .
4,706,932 11/1987 Yoshida et al. .
4,783,043 11/1988 Koerber .
5,085,284 2/1992 Fu ..... 175/296

*Primary Examiner*—Thuy M. Bui
*Attorney, Agent, or Firm*—John J. Selko

[57] ABSTRACT

A pressure sensitive valve for a fluid-actuated percussive drill includes passageways for fluid flow to expose a valve surface to a burst of short-interval, high pressure fluid from a drive chamber to cause early closing of the valve.

7 Claims, 6 Drawing Sheets

PRESSURE REVERSING VALVE FOR A FLUID-ACTUATED, PERCUSSIVE DRILLING APPARATUS

BACKGROUND OF THE INVENTION

This invention relates generally to rock drills and more particularly to rock drills that are percussive, fluid-actuated drills.

U.S. Pat. No. 5,085,284 claims a hybrid, pneumatic percussive rock drill wherein the point of admission of fluid into a drive chamber is controlled by a valve whose opening and closing is pressure sensitive. From the stand point of efficient use of fluid, it would be desirable to be able to control even more precisely the point in the drive stroke that the valve closes to shut off flow of percussive fluid to the drive chamber.

The foregoing illustrates limitations known to exist in present fluid-actuated percussive rock drills. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pressure sensitive valve for alternately opening and closing the drive chamber of a rock drill wherein the valve has a first valve pressure surface in communication with the drive chamber; a second valve pressure surface in communication with a high pressure port; a third valve pressure surface in communication with a fluid outlet passageway; first passageway means for permitting a limited volume of fluid to travel between the high pressure port and the drive chamber when the valve is in the open position; second passageway means for permitting a limited volume of high pressure fluid to travel between the drive chamber and the third valve pressure surface when the valve is in the open position, during a portion of a drive stroke of a piston; and third passageway means for permitting a limited volume of fluid to travel between the fluid outlet passageway and the third valve pressure surface, when the valve is in either the open or closed position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1A:
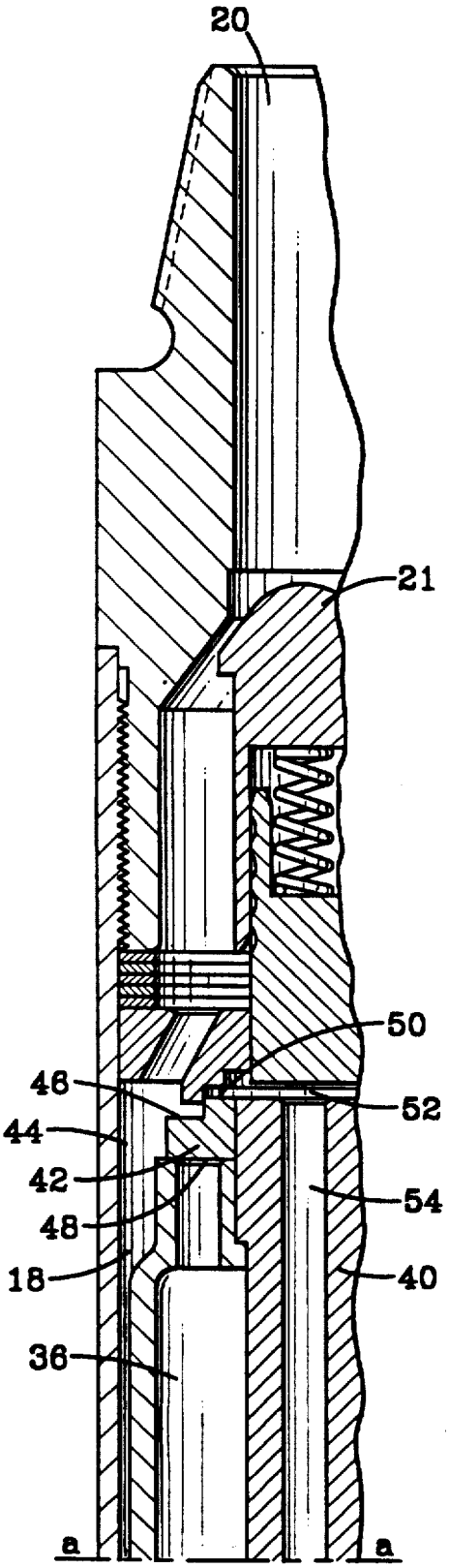
FIG. 1A is a sectional view illustrating an embodiment of the upper left portion of a prior art hybrid rock drill, with the piston in the return position.

Referring now to the drawings, FIGS. IA, IB, 2A, and 2B illustrate an embodiment of the hybrid percussion rock drill of the prior art in which identical elements will be similarly numbered throughout the figures.

A rock drill is shown generally 10. Even though the particular rock drill shown in the Figures is of a down the hole type, the instant invention may be similarly applied to an out of the hole rock drill. A wear sleeve 12 contains elements of the rock drill 10. A piston 14 reciprocally impacts with a bit 16 of the rock drill. The piston 14 moves in either a drive direction shown by arrow 14*a*, or a return direction shown by arrow 14*b*.

High pressure fluid passes via high pressure ports 18 to the remainder of the drill, thereby providing the motive force on the piston 14. High pressure fluid is supplied through a fluid supply line 20. A check valve 21 prevents a reverse flow of fluid from the drill through the supply line once pressure in the supply line 20 ceases.

Figure 2A:
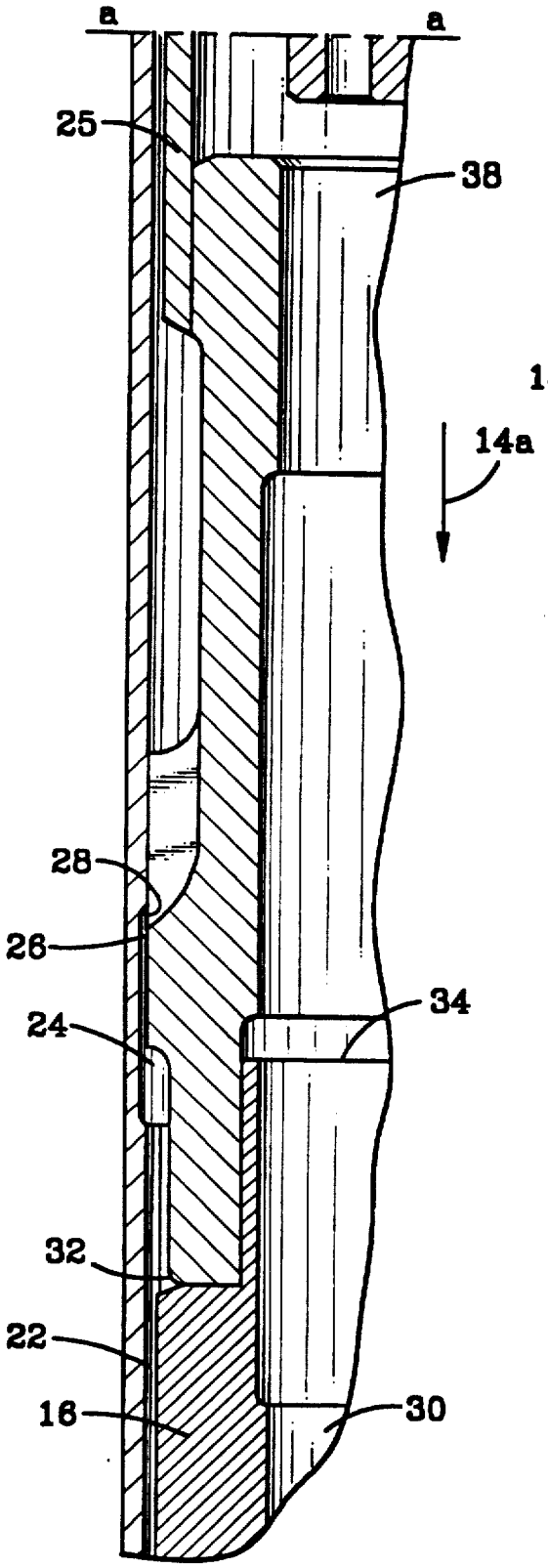
FIG. 2A is a sectional view illustrating an embodiment of the lower left portion of a prior art hybrid rock drill, with the piston in the return position.
Figure 2B:
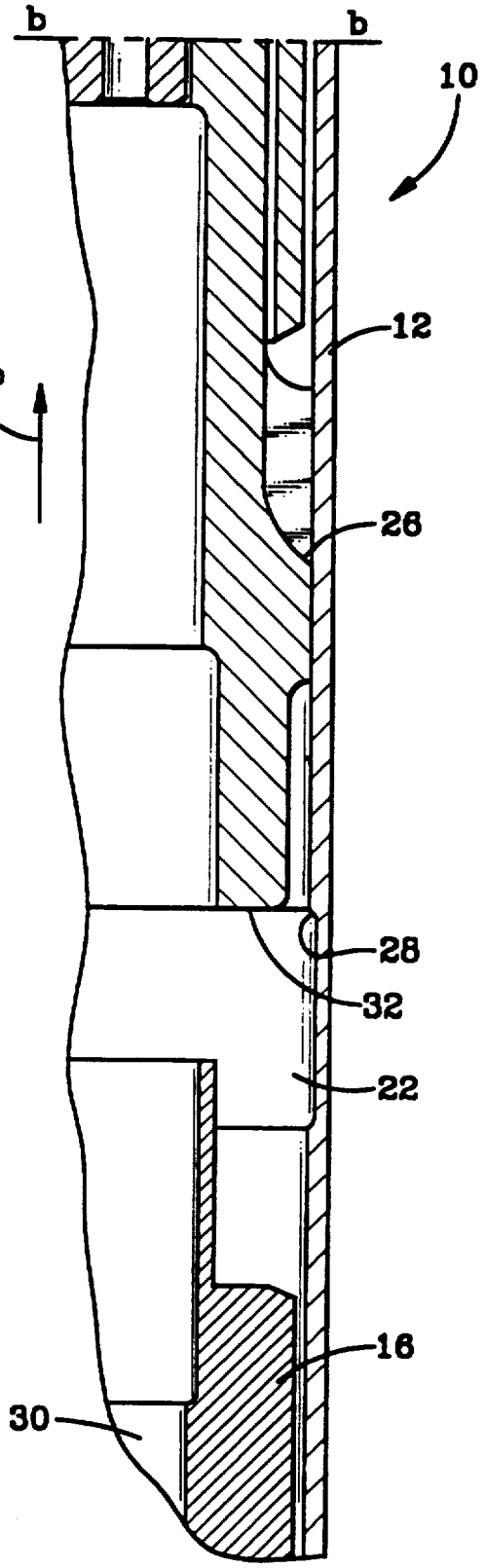
FIG. 2B is a sectional view illustrating an embodiment of the lower right, portion of a prior art hybrid rock drill, with the piston in the drive position.

A return chamber 22 (FIG. 2A,2B) is in fluid engagement with the high pressure port 18 via a fluid passage 24 when the piston 14 is in close proximity to the bit 16. Passage 24 is formed by internal cylinder 25 in combination with wear sleeve 12, as is well known. Any pressure in the return chamber 22, biases the piston in the return direction 14*b*. The high pressure port 18 pressure continues to be applied to the return chamber until a piston passage sealing point 26 passes a wearsleeve passage sealing point 28.

An outlet pressure vent 30 is formed in the bit 16, via a bore therethrough. Pressure will continue to accelerate the piston in the return direction 14*b* until a return pressure surface 32 of the piston passes an outlet 34 to the outlet pressure vent 30. At this time, any pressure in the return chamber 22 exhausts through the outlet port, but the momentum of the piston continues to carry the piston in the return direction 14*b*.

Since a drive chamber 36 (FIG. 1A,) is in communication with the outlet pressure through vents 30 and 38, the pressure in drive chamber 36 will continue to be that of the outlet port 30 until the end of a distributor 40 seals off a passage from the drive chamber to the outlet pressure vent 38, which includes a bore through piston 14. At this time, the fluid in the drive chamber 36 will be compressed. This compression will increase the pressure, gradually slowing down the return travel of the piston 14.

A pressure sensitive valve 42 controls the fluid flow from a high pressure inlet 44 through a valve opening 56 and a passage 59 to the drive chamber 36 (FIG. IB). The valve 42 shown in FIGS. 1A and 1B contains three pressure surfaces 46, 48 and 50. The pressure surface 46 is always exposed to the pressure inlet 44 pressure. The pressure surface 48 is exposed to the drive chamber 36 pressure when the valve is closed. The pressure surface 50 is always exposed to outlet pressure, regardless of position of valve 42.

When the valve is open, the pressure surface 48 can be designed to control the fluid flow between chamber 36 and the inlet 44 by controlling the dimension of the valve opening 56 and the fluid passage 59. A pressure port 52, which is exposed to pressure through vent 54 regardless of the position of the valve 42, communicates with pressure surface 50.

Figure 1B:
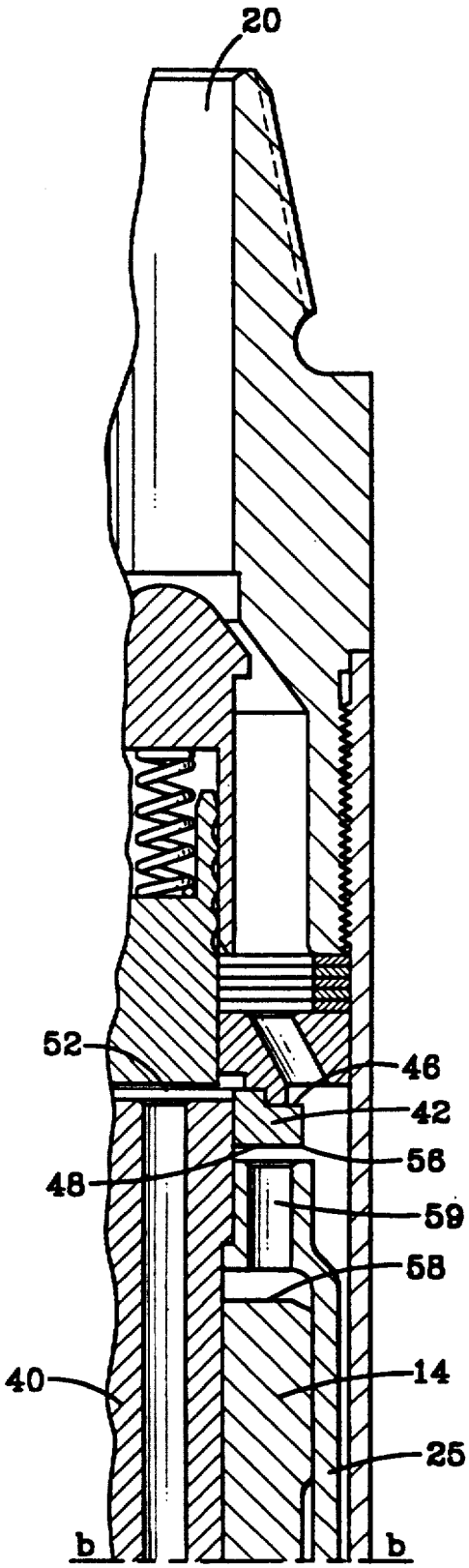
FIG. 1B is a sectional view illustrating an embodiment of the upper right portion of a prior art hybrid rock drill, similar to FIG. 1a, except with the piston in the drive position.

When the piston 14 moves in the return direction 14b to such an extent that the force acting on pressure surface 48 exceeds the combined pressure forces acting on pressure surfaces 46 and 50, then the pressure valve 42 will open as shown in FIG. 1B. An open valve permits high pressure air to pass from the pressure inlet 44, through the valve opening 56 and passage 59, to drive chamber 36.

The resulting pressure increase in the drive chamber from the opening of the valve will first cause the return travel of the piston 14 to halt, and then the piston 14 will rapidly accelerate in the drive direction 14a. As soon as a piston drive face 58 passes the end of the distributor 40, the drive chamber will be exhausted to the outlet pressure through atmospheric vents 38 and 30.

Figure 5:
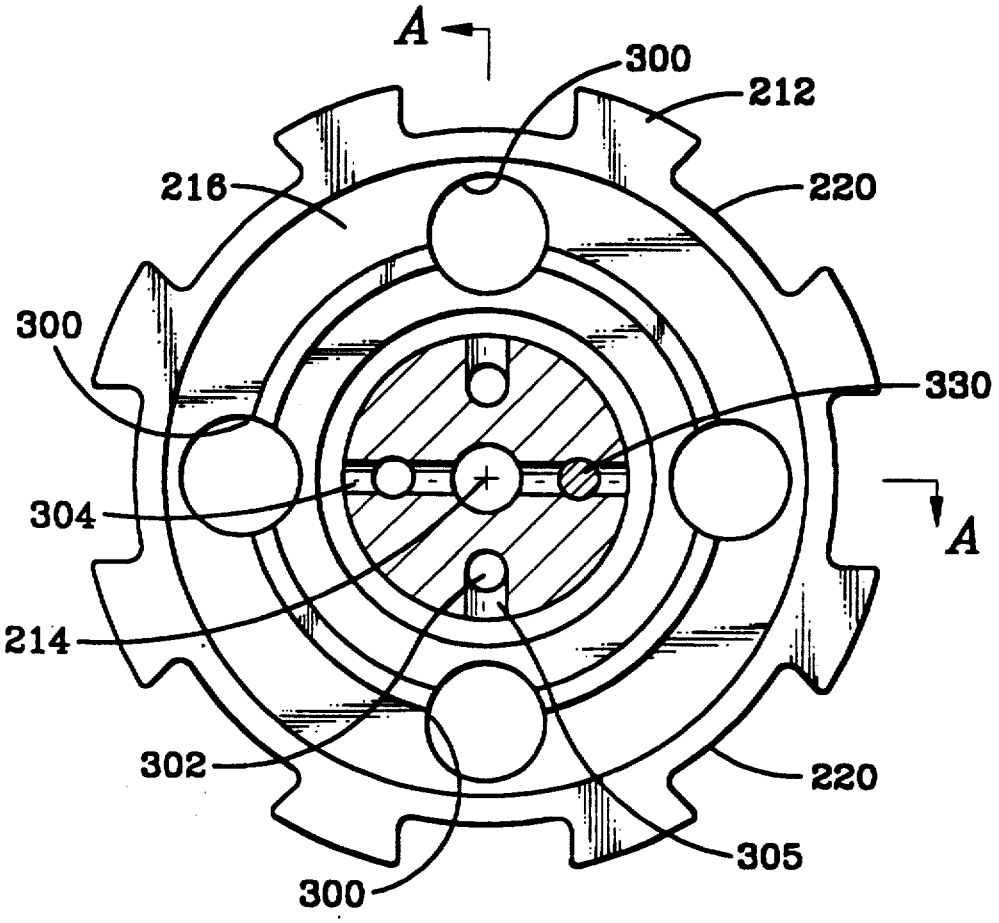
FIG. 5 is a view along A—A of FIG. 4, with parts removed.
Figure 6:
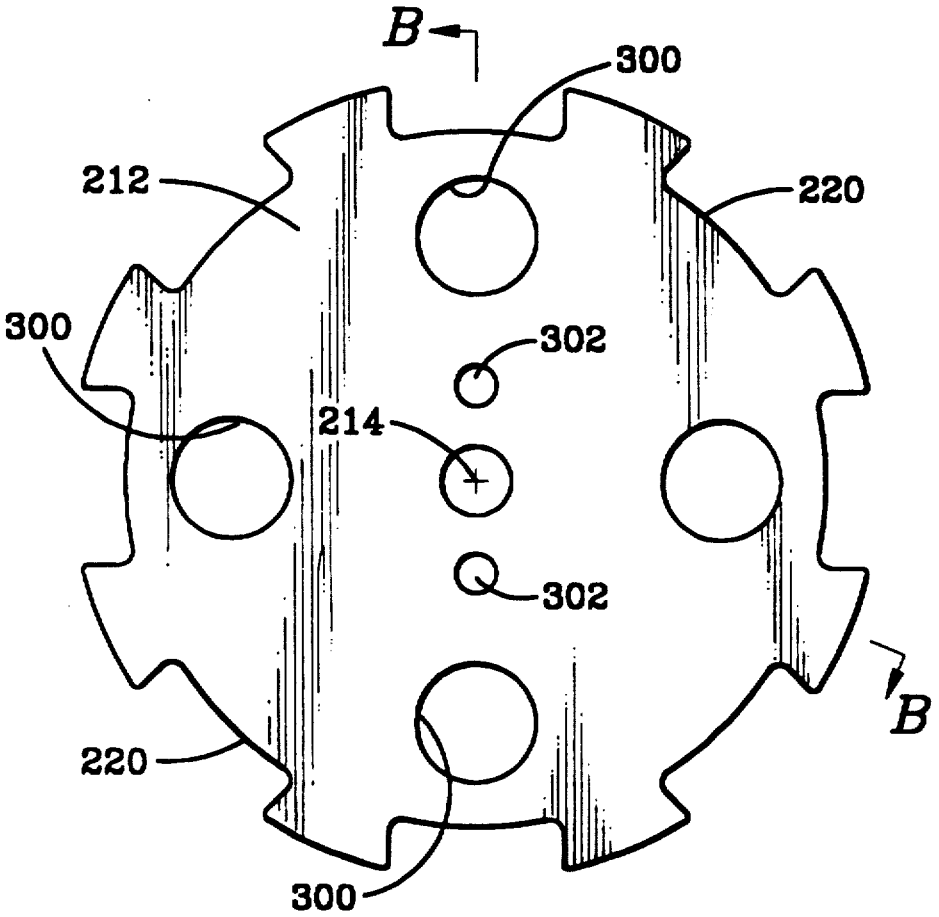
FIG. 6 is a view along B—B of FIG. 4, with parts removed.

Now referring to FIGS. 3–6, the reversing valve 200 of the invention will be described. Valve 200 has a first pressure sensitive surface 202, a second pressure sensitive surface 204 and a third pressure sensitive surface 206, as does valve 42. Valve 200 further comprises a fluid distributor subcombination 210 that is adapted for positioning in the wear sleeve 12, for distributing high pressure fluid from high pressure port 44 to drive chamber 36 and return chamber 22, as described hereinafter. Air distributor subcombination 210 includes a body portion 212 extending radially from a longitudinal axis 214, the body portion 210 having a top seal seat surface 216 and a bottom surface 218. As seen in FIGS. 5 and 6, the body 212 has a plurality of undercuts 220, spaced around axis 214, and extending longitudinally from top seal seat surface 216, to provide, in combination with internal surface of wear sleeve 12 and internal cylinder 25 a passageway 24 for fluid to flow to return chamber 22 as described hereinabove. Internal cylinder 25 can be integral with body 212 of distributor 210 or it can be fastened thereto, in combination with O-ring seals 222.

A valve stem 230 extends longitudinally from top seal seat 216, coinciding with axis 214. A valve cap 232 is adapted for positioning sealingly in wear sleeve 12 and also sealingly fitted onto valve stem 230 at top end 234. Valve seal 236 is slidable along valve stem 230 between seal seat surface 216 and valve cap 232, to open and close drive chamber 36. A distributor tail stem 240 extends longitudinally from bottom surface 218, and coincides with axis 214. Tail stem 240 is adapted to slidingly contact piston 14 to seal and unseal against piston 14 during reciprocation, as described hereinabove.

Valve seal 236 is sealingly fitted, by means of optional elastomeric O-rings 238, to contact valve cap 232 and valve stem 230 respectively. First passageway means includes at least one aperture 300 extending through body portion 212 to connect high pressure port 44 with drive chamber 36. As seen in FIGS. 5–6, we prefer a plurality of such apertures 300 spaced around axis 214.

Second passageway means includes at least one longitudinal aperture 302 extending through tail stem 240, body 212 and valve stem 230 to a radially extending valve stem passageway 305 communicating with third valve pressure surface 206, by way of a chamber 306 between valve cap 232 and valve stem 230. As seen in FIGS. 5–6, we prefer a plurality of apertures 302 spaced around axis 214.

Third passageway means includes at least one longitudinal aperture 310 extending through tail stem 240, body 212 and valve stem 230 to radially extending valve stem passageway 304. Aperture 310 can extend through valve cap 232 to a check valve (not shown) as is well known. We prefer third passageway 310 to be a central bore along axis 214, which coincides with a central bore axis of the entire drill 10.

Figure 4:
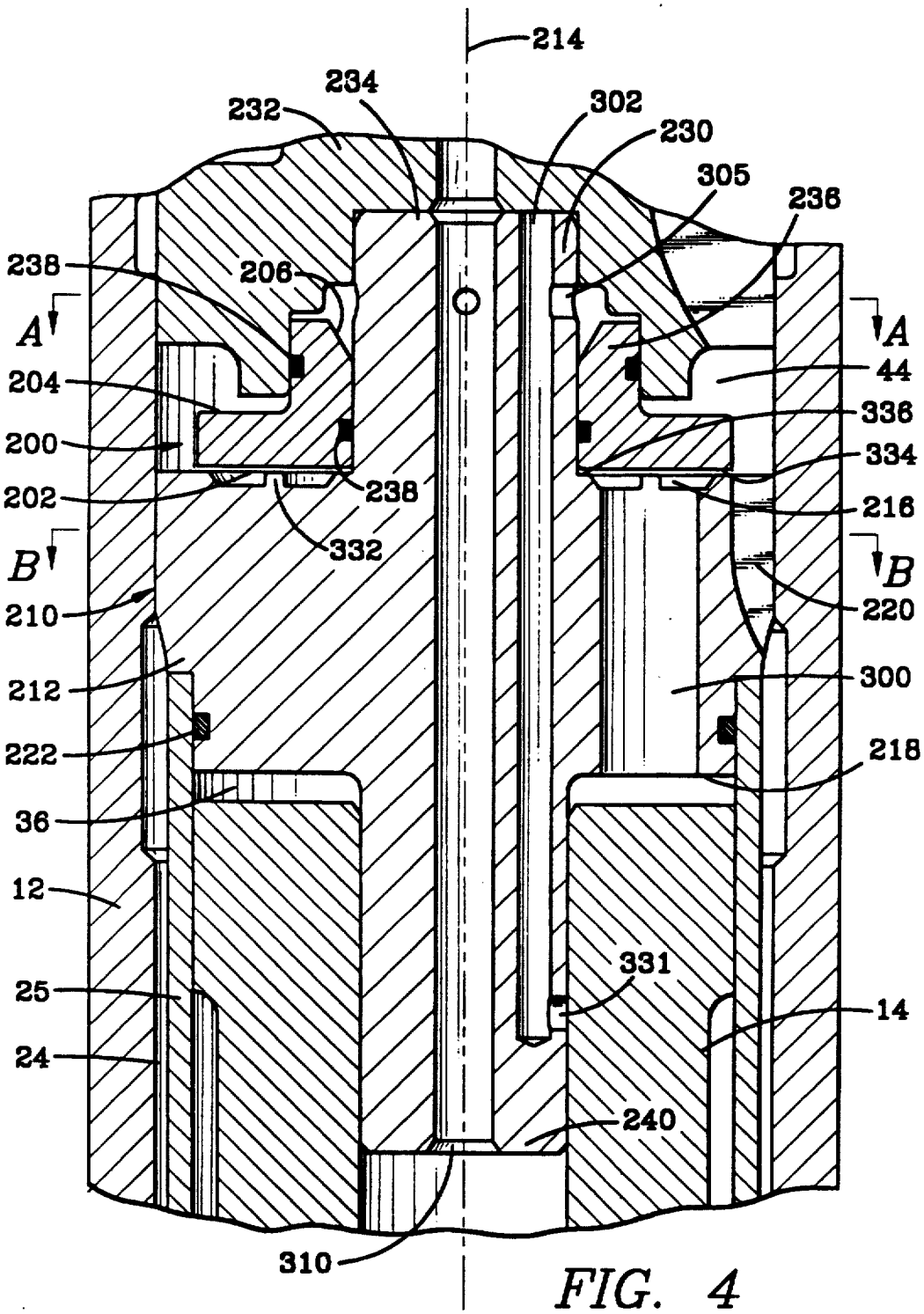
FIG. 4 is a view similar to FIG. 3, viewed along lines B—B of FIG. 6, with the valve in the open position.

As seen in FIG. 4, when piston 14 is in the drive position, valve 200 is open, and drive chamber 36 is pressurized, while return chamber 22 (FIG. 2B) is being exhausted to exhaust means 30, 34, as described hereinabove. First valve pressure surface 202 is exposed to high fluid pressure in drive chamber 36. Also, third valve pressure surface 206 is exposed to exhaust pressure via third passageway means (aperture 310). At the same time, second valve pressure surface 204 is exposed to high pressure from inlet port 44.

Figure 3:
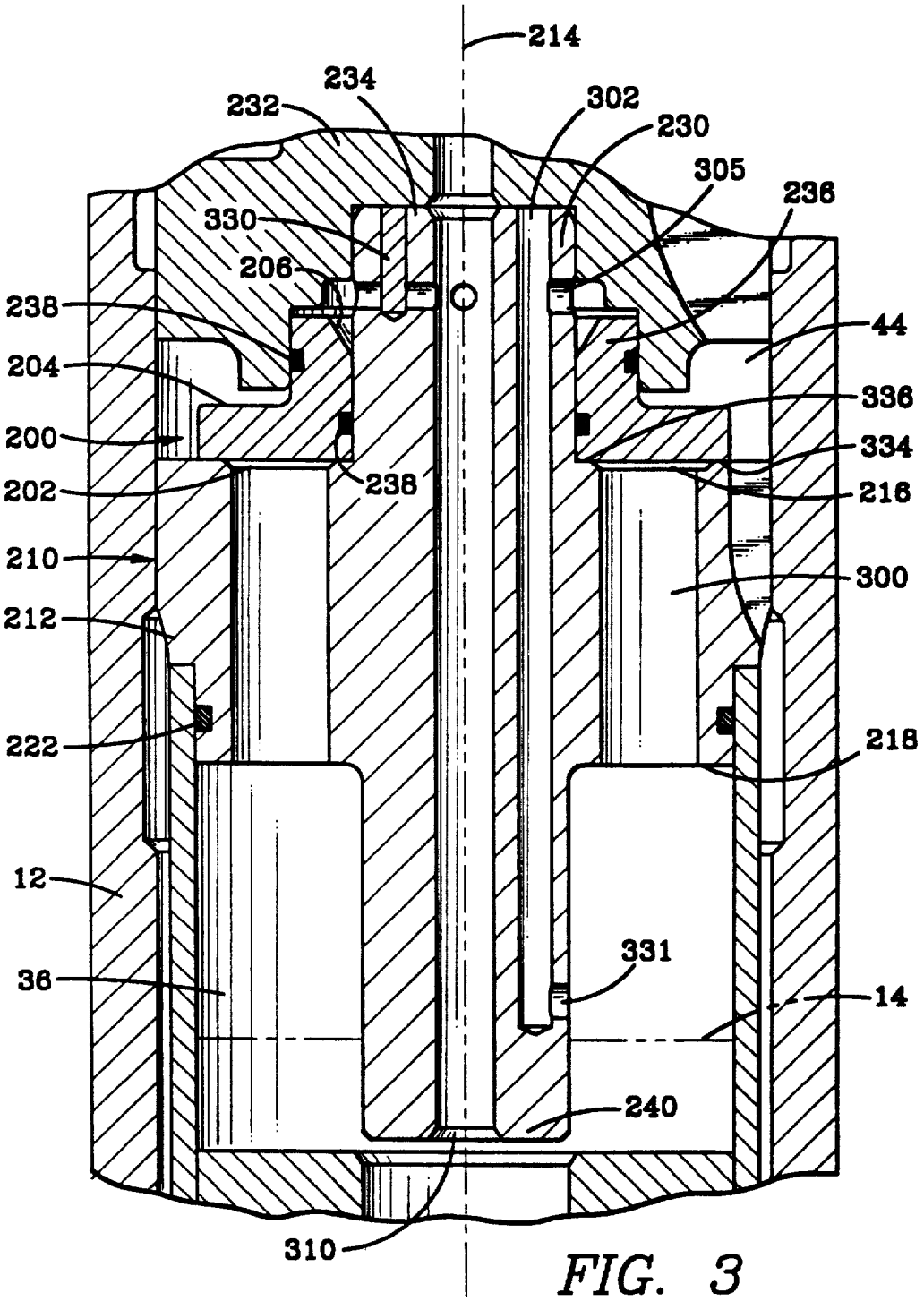
FIG. 3 is a sectional view of a top portion of a rock drill, with parts removed, viewed along lines A—A of FIG. 5, illustrating a valve closing device of the invention, with the valve in the closed position.

As seen in FIG. 3, during drive stroke, piston 14 moves its top surface to below opening 331 in a sidewall of stem 240 (a piston 14 position shown in phantom), thereby uncovering opening 331, and subjecting passageway 302 and third valve pressure surface 206 to high pressure from drive chamber 36. This high pressure fluid force lasts only for a very short time interval, until piston 14 loses contact with stem 240, shown in solid lines in FIG. 3. Thereafter, drive chamber 36 is exposed to exhaust pressure as are both second and third passageway means (passageways 302 and 310, respectively) exposing third valve pressure surface 206 only to exhaust pressure. However, this short-interval, high pressure force on valve surface 206 is additive to t hose pressures already acting on valve surfaces 204 and 206, as described hereinabove, and the increased total force will cause valve 200 to close earlier in the drive stroke than it usually would. The exact timing of this early close can be varied by adjusting the total cross-sectional area of the passageway 302. For a given cross-sectional area, the closing is also dependent upon the total cross sectional area of the valve stem passageways 304. A larger cross-sectional area 302 or a smaller stem passageway 304 will result in earlier valve closing to cause reduced air consumption. As shown in FIGS. 5 and 6, we prefer to provide a plurality of passageways 302, and 304 but to adjust the total cross sectional area by inserting one or more removable plugs 330 (FIGS.3,5 shown for passageways 304) during assembly of the drill. Thus, the valve closing position during the drive stoke of piston 14 can be selected by the operator who can use fewer or more removable plugs 330, by disassembling the backhead of the drill to gain access to the valve 200.

We prefer to provide an optional support for valve seal 236 on first valve pressure surface 202 by means of a plurality of lands 332 spaced around axis 214 and between outer seal seat edge 334 and inner seal seat edge 336.

Having described the invention, what is claimed is:

1. A pressure sensitive valve for pressurizing a drive chamber in a fluid-actuated, percussive apparatus, during the reciprocation of a piston in said apparatus comprising:

i. a first valve pressure surface in communication with the drive chamber;

ii. a second valve pressure surface in communication with a high pressure port;

iii. a third valve pressure surface in communication with a fluid outlet passageway;

iv. first passageway means for permitting a limited volume of fluid to travel between the high pressure port and the drive chamber when the valve is in the open position;

v. second passageway means for permitting a limited volume of high pressure fluid to travel between the drive chamber and the third valve pressure surface when the valve is in the open position, during a portion of a drive stroke of a piston; and vi. third passageway means for permitting a limited volume of fluid to travel between the fluid outlet passageway and the third valve pressure surface, when the valve is in either the open or closed position.

2. In a fluid actuated percussion rock drill apparatus having a hollow wear sleeve, a piston slidingly disposed within the wear sleeve, drive and return pressure surface means for reciprocating the piston between a return and a drive position, respectively, a high pressure port defined within the drill apparatus, a return chamber defined with the drill apparatus and exposed to the return pressure surface means, a drive chamber defined within the drill apparatus and exposed to the drive pressure surface means, an outlet means for alternately exhausting the drive chamber and the return chamber, when the piston in the return and drive position, respectively, the improvement comprising:

a. a pressure sensitive valve means for pressurizing the drive chamber during the reciprocation of the piston comprising:

i. a first valve pressure surface in communication with the drive chamber;

ii. a second valve pressure surface in communication with the high pressure port;

iii. a third valve pressure surface in communication with the outlet means;

iv. first passageway means for permitting a limited volume of fluid to travel between the high pressure port and the drive chamber when the valve means is in the open position;

v. second passageway means for permitting a limited volume of high pressure fluid to travel between the drive chamber and the third valve pressure surface when the valve means is in the open position, during a portion of a drive stroke of a piston; and vi. third passageway means for permitting a limited volume of fluid to travel between the outlet means and the third valve pressure surface, when the valve means is in either the open or closed position.

3. The valve of claim 1 further comprising:

a. air distributor subcombination means adapted for positioning in the wear sleeve, for distributing high pressure fluid from the high pressure port to the drive chamber and return chamber;

b. said first passageway means including means in the air distributor subcombination for communicating between the high pressure port and the drive chamber;

c. said second passageway means including means in the air distributor subcombination for communicating between the drive chamber and the third valve pressure surface, when the valve seal means is in the open position, during a portion of a piston drive stroke;

d. valve seal means on said air distributor subcombination for opening and closing during reciprocation of the piston to open and close said first passageway means; and e. said third passageway means including means in the air distributor subcombination for communicating between the outlet means and the third valve pressure surface.

4. The valve of claim 3 wherein the air distributor subcombination further comprises:

a. a body portion radially extending from a longitudinal axis, said body portion having a top seal seat surface and a bottom surface;

b. a valve stem longitudinally extending from said top seal seat surface;

c. a valve cap adapted for positioning in the wear sleeve and sealingly fitted onto said valve stem;

d. said valve seal means slidable along said valve stem between said seal seat surface and said valve cap to open and close said drive chamber; and e. a tail stem longitudinally extending from said bottom surface, adapted to slidingly contact a piston, to seal and unseal against a piston bore during reciprocation of the piston.

5. The valve of claim 4 further comprising:

a. said first passageway means being at least one longitudinal aperture through said body portion, connecting said high pressure port and said drive chamber;

b. said second passageway means being at least one longitudinal aperture extending through said tail stem, said body portion, and said valve stem to a valve stem passageway communicating with said third valve pressure surface;

c. said third passageway means being at least one longitudinal aperture extending through said tail stem, said body portion, and said valve stem to said valve stem passageway; and d. said second passageway means having an opening into said drive chamber from a portion of said tail stem that is closer to said body portion than is an opening into said drive chamber from said third passageway means, whereby said second passageway opening is uncovered before said third passageway opening, during a piston drive stroke.

6. The rock drill of claim 2 wherein the third valve pressure surface means is on the same side of the valve means as the second valve pressure surface means.

7. The rock drill of claim 6 wherein, during a portion of a drive stroke, a component of fluid pressure force exerted on the third valve surface plus a component of fluid pressure force exerted on the second valve surface exceeds a component of fluid pressure force exerted on the first valve surface, whereby the valve is biased into a closed position.

* * * * *